United States Patent [19]

Tsuji

[11] Patent Number: 4,840,300

[45] Date of Patent: Jun. 20, 1989

[54] PAPER CONVEYING ROLLER FOR IMAGE FORMING APPARATUS

[75] Inventor: Masaru Tsuji, Nara, Japan

[73] Assignee: Sharp Kabushiki Kaisha, Osaka, Japan

[21] Appl. No.: 27,428

[22] Filed: Mar. 18, 1987

[30] Foreign Application Priority Data

Mar. 18, 1986 [JP] Japan ..... 61-40211[U]

[51] Int. Cl.[4] ..... B65H 5/06; B65H 9/00; B41J 13/02; B41J 13/03

[52] U.S. Cl. ..... 226/187; 226/190; 226/194

[58] Field of Search ..... 226/181, 186, 187, 190, 226/194; 384/58, 548, 549, 567, 581

[56] References Cited

U.S. PATENT DOCUMENTS

| | | | |
|---|---|---|---|
| 1,897,054 | 2/1933 | Hunter . | |
| 2,622,448 | 12/1952 | Lorig | 226/190 X |
| 2,873,657 | 2/1959 | Bartlett et al. | 226/187 X |
| 3,039,665 | 6/1962 | Swanson | 226/187 X |
| 3,107,036 | 10/1963 | Richards et al. | 226/190 X |
| 3,587,961 | 6/1971 | Ritter | 226/187 X |
| 3,589,582 | 6/1971 | Fujimoto | 226/187 X |
| 4,452,524 | 6/1984 | Parisi . | |
| 4,752,145 | 6/1988 | Schelshorn et al. | 226/194 X |

FOREIGN PATENT DOCUMENTS 3041971 5/1981 Fed. Rep. of Germany .

*Primary Examiner*—John Petrakes

*Attorney, Agent, or Firm*—Birch, Stewart, Kolasch & Birch

[57] ABSTRACT

Disclosed is a paper conveying roller configuration for an image forming apparatus composed of a lower unit and an upper unit, the latter which is rotatably pivoted on the lower unit, having a paper conveying passage formed at the boundary surface or junction of these upper and lower units, with one of a pair of paper conveying roller configuration being disposed on the upper unit and the other one on the lower unit, wherein one of the paper conveying roller configuration is supported by a series of springs.

4 Claims, 3 Drawing Sheets

PAPER CONVEYING ROLLER FOR IMAGE FORMING APPARATUS

BACKGROUND OF THE INVENTION

This invention relates to an image forming apparatus being divided into an upper unit and a lower unit, with the upper unit rotatably supported on the lower unit, and more particularly to a paper conveying roller for the image forming apparatus having a paper conveying passage formed on the boundary surface of the upper and lower units, with one of a pair of paper conveying rollers disposed on the upper unit and the other pair on the lower unit.

A paper conveying apparatus used in an image forming apparatus such as copying machine is composed of a pair of paper conveying rollers, conveying guide, and others. The paper conveying passage including these paper conveying rollers and conveying guide is disposed from the paper feed part to the paper discharge part of the image forming apparatus, and it is designed to process image forming on the paper in the process of conveyance. In a copying machine, for example, a photosensitive drum is disposed within the paper conveying passage, and the paper being conveyed is caused to contact with the surface of the photosensitive drum in the transfer process during the copying process, and the electrostatic toner image formed on the photoreceptor surface is transferred to the paper. In this composed copying machine, in order to transfer the toner image formed on the surface of photosensitive drum onto a correct position of the paper, the conveyance of paper must be synchronized accurately with the rotation of the photosensitive drum, and the capability of the paper conveying passage must be improved, too.

On the other hand, for the ease of removal of a jamming paper, in existing commercial products, for example, the image forming apparatus is divided into upper and lower units, and the upper unit is rotatably pivoted on the lower unit, while a paper conveying passage is formed on the boundary surface of the upper and lower units. In such an image forming apparatus, one of a pair of paper conveying rollers in the paper conveying passage is disposed on the upper unit and the other pair is disposed on the lower unit. In the conventional image forming apparatus having such a construction, since the mounting positions of the shafts of the upper and lower rollers of the paper conveying rollers are completely fixed on the upper unit and lower unit, the relative positions of these rollers and the roller contacting pressures are not constant depending on the opening or closing state of the upper and lower units, and the capacity of the paper conveying passage is not stable. As a result, jamming occurs often or the transfer position of the electrostatic toner image is not constant.

SUMMARY OF THE INVENTION

It is hence a primary object of this invention to present a paper conveying roller system for an image forming apparatus capable of always keeping constant the relation of position and pressure of the upper and lower rollers of the paper conveying rollers, preventing the paper conveying capacity from varying.

Briefly described, the present invention is characterized in that one of the paper conveying roller configuration is supported by a series of springs in such an image forming apparatus composed of a lower unit and an upper unit the latter being rotatably pivoted on the lower unit, with the paper conveying passage being formed at the boundary juncture of the upper and lower units, with one of a pair of paper conveying roller configuration being disposed on the upper unit and the other on the lower unit.

In accordance with the present invention, since one of the paper conveying roller configuration is supported by a series of springs, if the mounting state of the upper and lower units varies, this deviation is absorbed by the springs, and the relation of position and pressure of the upper and lower units is always kept constant. Accordingly, variations of the conveying capacity may be eliminated, and frequency of jam occurrences may be lowered, while the transfer position of the electrostatic toner image may be stabilized.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION

Embodiments

Figure 2:
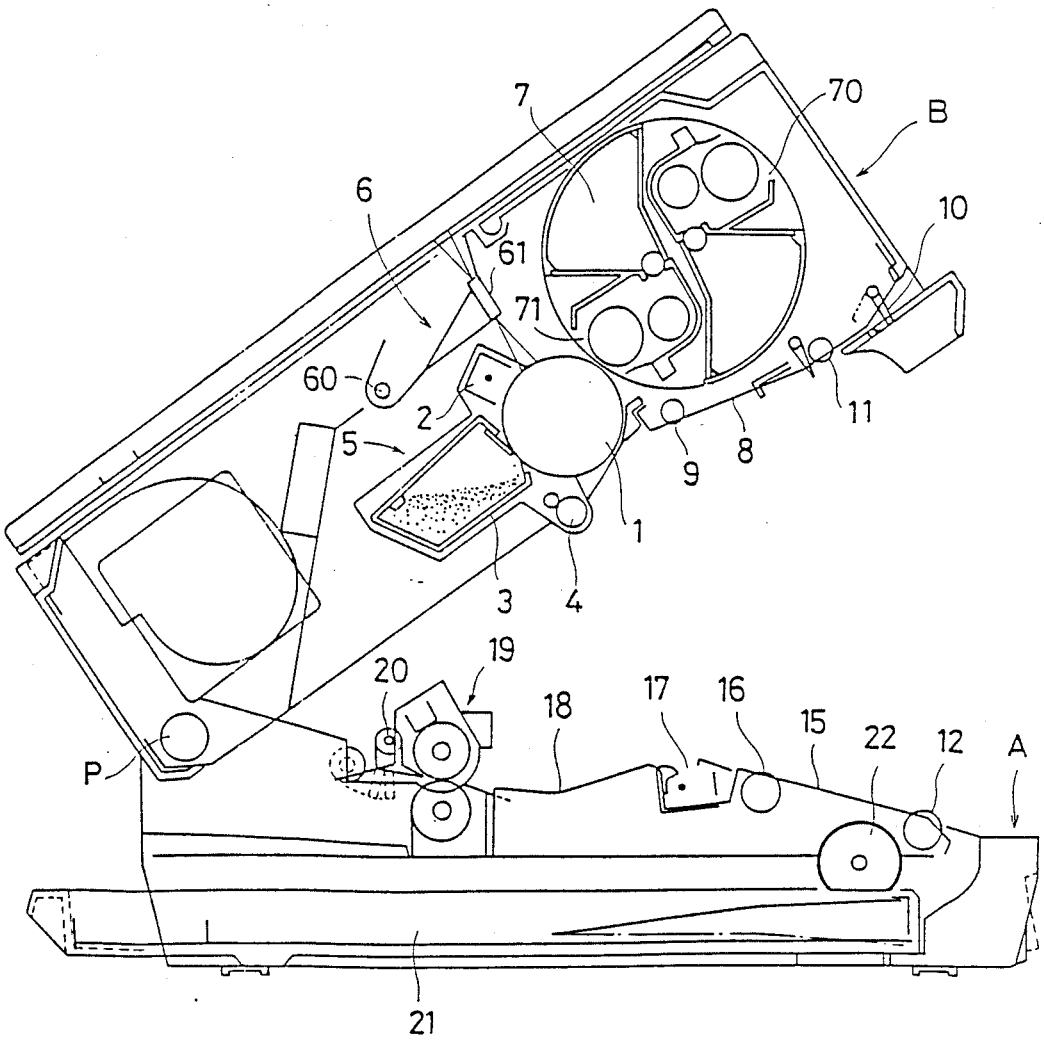
FIG. 2 and FIG. 3 are side, sectional views of the same copying machine, FIG. 2 showing an opened state of the upper and lower units and FIG. 3 showing a closed state of the same upper and lower units.
Figure 3:
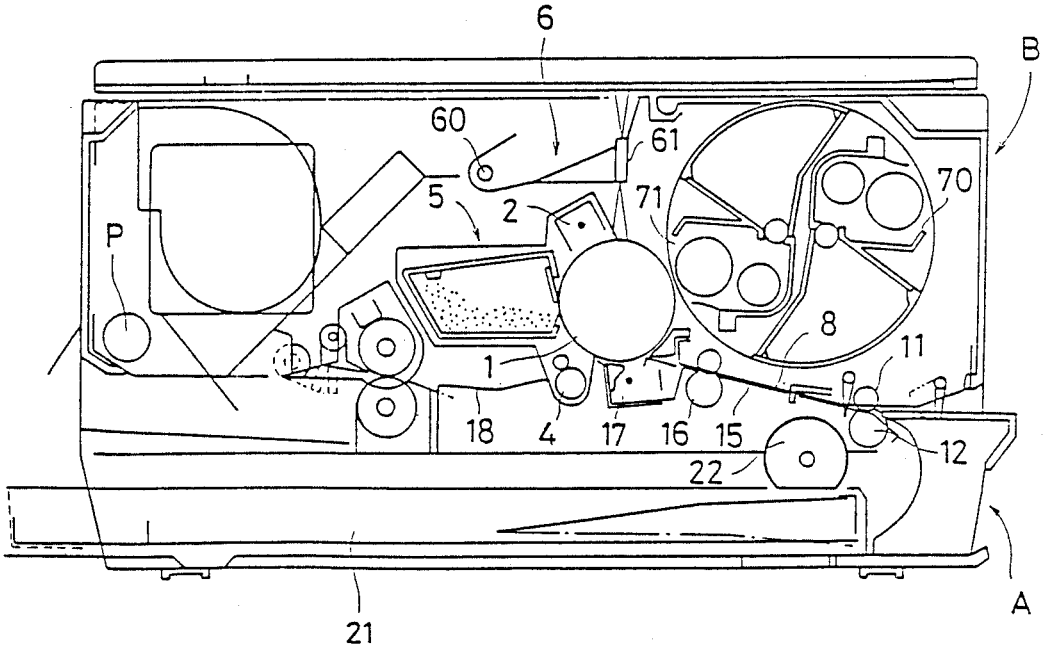

The copying machine of FIGS. 2 and 3 is composed of a lower unit A and on upper unit B. The upper unit B is pivoted on the lower unit A at fulcrm P, and can rotate about this fulcrum P.

The upper unit B possesses a replacement unit 5 which integrally comprises a photosensitive drum 1, primary charger 2, cleaner unit 3, and separation roller 4. This replacement unit can be freely attached to or detached from the upper unit B by means of a detaching mechanism (not shown). Above this replacement unit 5 is disposed an optical system 6 consisting of light a source 60 and focusing light transmitter 61. At the right side of the photosensitive drum, a developing device 7 comprising a first developing unit 70 and second developing unit 71 is rotatably provided. The first developing unit 70 and second developing unit 71 are filled with toners of different colors. By rotating the developing device 7, either developing unit may be brought opposite to the photosensitive drum 1. Ahead of the photosensitive drum 1, there is a paper conveying guide 8, and a timing roller (PS roller) 9 and a paper feed roller configuration 11 are mounted on this guide, while a hand feed paper detection switch 10 is provided at the right end of the upper unit B.

In the upper right part of the lower unit A, there is a paper conveying guide 15, and on this paper conveying guide 15 are mounted a lower PS roller 16 opposing the PS roller 9 of the upper unit B above and a lower paper feed roller configuration 12 opposite to the paper feed roller configuration 11. At the left side of the PS roller 16, there is a transfer device 17 which is opposite to the photosensitive drum 1 when the upper and lower units A, B are in the mounted or closed state and at its left side, a conveying guide 18 for conveying the transfer paper is provided. At the left side of this conveying guide 18, a fixing roller unit 19 is disposed, and at its left side, there is a discharge paper detection switch 20 for detecting the paper discharged from the fixing roller unit. Furthermore, at the bottom of this lower unit A, a paper feed cassette 21 is detachably mounted, and at its paper feed site a paper feed roller 22 is provided. The paper supplied from the paper feed cassette 21 by the paper feed roller 22, is conveyed up to the transer part of the photosensitive drum 1 by way of the paper feed rollers configurations 11, 12, paper conveying guides 8, 15, and PS rollers 9, 16.

The paper conveying guides 8, 15, and 18 are formed at the boundary surface or zone between the upper and lower units A, B, as shown in the drawing, and a paper conveying passage is defined. Of the paper feed rollers and PS rollers, the upper side rollers 11, 9 are mounted on the upper unit B and the lower side rollers 12, 16 are mounted on the lower unit A.

Figure 1:
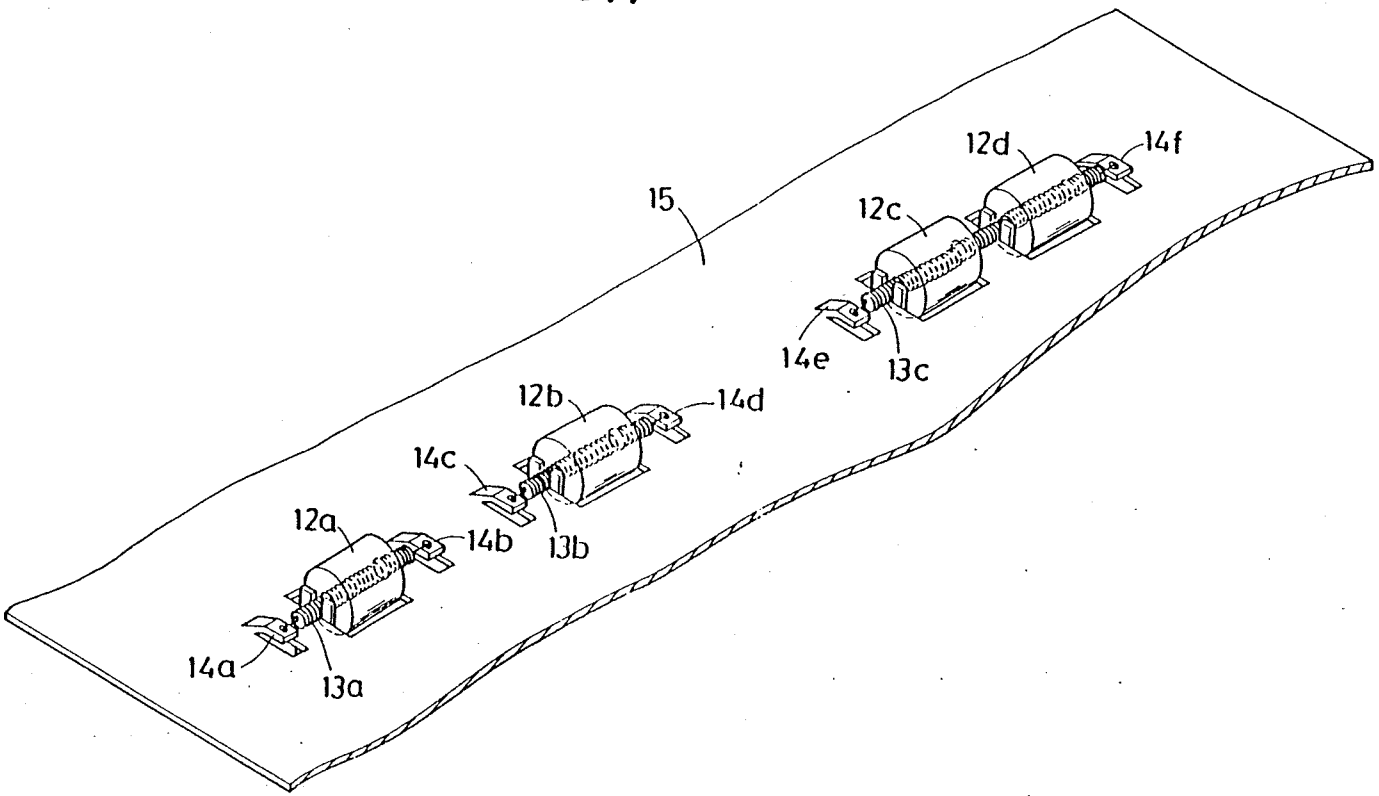
FIG. 1 is a structural segmental drawing of a lower paper feed roller configuration of a copying machine as one of the embodiments of the present invention.

FIG. 1 shows the mounting of the lower paper feed roller configuration 12 on the lower unit A. The lower paper feed roller configuration 12 is composed of four rollers 12*a* to 12*d* parallel to the rotary shaft of the photosensitive drum 1. Through centers of rollers 12*a*, 12*b*, springs 13*a*, 13*b* penetrate, and the ends of these springs 13*a*, 13*b* are attached at support parts 14*a*, 14*b*, 14*c*, and 14*d* provided on the paper conveying guide 15. In this structure, the rollers 12*a*, 12*b* rotate about the springs 13*a*, 13*b*, and can also be adjusted by the action of the springs. The rollers 12*c*, 12*d* are supported by one spring 13*c*. These rollers 12*c*, 12*d* can also rotate around the spring 13*c*, and can also be adjusted. In this embodiment, thus, the lower paper feed rollers 12*a*–12*d* of a pair of paper feed roller configurations 11, 12 are supported by springs 13*a* to 13*c*. Therefore, when the upper and lower units A, B are mounted or closed, if the position of the upper unit A and paper feed roller 11 is deviated by a certain cause, this deviation is absorbed by the springs 13*a*–*c*. That is, the contact position and contact pressure of the upper and lower paper feed rollers 11, 12 are always constant. Accordingly, fluctuations of the conveying force by the paper feed rollers may be restricted, and a stable paper conveyance may be realized.

Incidentally, the rollers other than the driving paper feed rollers, PS rollers 9, 16, may be also supported by springs as shown in FIG. 1. In this embodiment, the springs will directly penetrate the center of the rollers, and the ends of the springs are fixed, but the same effect will be obtained when the shafts of the rollers are supported by springs.

Therefore, by supporting one of the paper conveying rollers with a spring, if the position of the other roller opposite to this roller should deviate, this deviation will be absorbed by the spring, and the contact position and contact pressure of the two rollers may be always kept constant.

While only certain embodiments of the present invention have been described, it will be apparent to those skilled in the art that various changes and modifications may be made therein without departing from the spirit and scope of the present invention as claimed.

What is claimed is:

1. A paper conveying roller device for an image forming apparatus composed of an upper unit rotatably pivoted on a lower unit, having a paper conveying passage formed at the boundary juncture between said upper and lower units, including at least one pair of paper conveying rollers, one of said paper conveying rollers of said at least one pair of paper conveying rollers being disposed on said upper unit of said image forming apparatus and the other of said paper conveying rollers being disposed on said lower unit of said image forming apparatus, wherein at least one of said rollers of said at least one pair of paper conveying rollers is supported by a spring means wherein said spring means passes through the center of said at least one paper conveying roller, each end of said spring means being attached to said image forming apparatus.

2. The device of claim 1, wherein said image forming apparatus comprises a guide member on said lower unit said guide member having mounted thereon said at least one paper conveying roller supported by said spring means attached to said image forming apparatus.

3. The device of claim 2, wherein said paper conveying roller mounted on said guide member comprises four rollers, two of which have a spring means which passes through the center of each respective roller and each spring is attached to said guide member and two of which are supported by one spring which passes through the centers of both rollers and is attached to said guide member.

4. The device of claim 1, wherein said paper conveying roller device includes one pair of timing rollers and one pair of paper feed rollers, one of said timing rollers and one of said paper feed rollers being disposed on said upper unit of said image forming apparatus and the other of said timing rollers and the other of said paper feed rollers beding disposed on said lower unit of said image forming apparatus, said paper feed roller disposed on said lower unit comprising four rollers, two of which have a spring means which passes through the center of each respective roller with each spring being attached to said lower unit of said image forming apparatus and two of which are supported by one spring which passes through the centers of both rollers with the single spring being attached to said lower unit of said image forming apparatus.

* * * * *